United States Patent [19]

Holden et al.

[11] Patent Number: 4,910,924

[45] Date of Patent: Mar. 27, 1990

[54] COMPOSITE GRINDING WHEEL

[75] Inventors: William L. Bouchard, Washington, N.H.; Robert L. Holden, Auburn, Mass.; Charles W. Sudol, Hillsboro, N.H.; Brian E. Swanson, Northboro, Mass.

[73] Assignee: Norton Company, Worcester, Mass.

[21] Appl. No.: 210,466

[22] Filed: Jun. 23, 1988

Related U.S. Application Data

[63] Continuation of Ser. No. 944,320, Dec. 22, 1986, abandoned.

[51] Int. Cl.[4] ..... B24D 7/14

[52] U.S. Cl. ..... 51/209 R; 51/207; 51/297

[58] Field of Search ..... 51/206.4, 206.5, 209 R, 51/209 DL, 206 R, 206 NF, 207, 168, 178, 376, 293, 298, 297

[56] References Cited

U.S. PATENT DOCUMENTS

| | | | |
|---|---|---|---|
| 639,035 | 12/1899 | Hart . | |
| 1,616,531 | 2/1927 | King . | |
| 1,928,314 | 9/1933 | Koss | 51/209 |
| 2,126,403 | 8/1938 | McIntyre | 51/209 R |
| 2,479,078 | 8/1949 | Milligan et al. | 51/209 |
| 3,067,551 | 12/1962 | Maginnis | 51/281 |
| 3,576,090 | 4/1971 | Shoemaker | 51/209 R |
| 3,867,795 | 2/1975 | Howard | 51/209 |
| 4,292,768 | 10/1981 | Panetti | 51/168 |

*Primary Examiner*—Robert Rose

*Attorney, Agent, or Firm*—Arthur A. Loiselle, Jr.

[57] ABSTRACT

A two zoned grinding wheel is disclosed having a lower section or zone composed of bonded abrasive grain and an upper zone or section made up of bonded particles of a material that is softer than the abrasive grain and therefore less abrasive. The wheel is especially suitable for being held in clamps or a chuck when being used, with the clamps or chuck contacting the wheel on the upper less abrasive section thus greatly reducing wear on said clamp or chuck.

8 Claims, 1 Drawing Sheet

COMPOSITE GRINDING WHEEL

CROSS REFERENCES TO RELATED APPLICATIONS

This is a continuation of application Ser. No. 944,320 filed Dec. 22, 1986, now abandoned.

TECHNICAL FIELD

The invention relates to composite grinding wheels and more specifically to grinding wheels which in use are held and driven by a chuck or clamping means which makes contact with the periphery of the sheel.

BACKGROUND AND INFORMATION DISCLOSURE STATEMENT

The following U.S. Pat. Nos. are representative of the most revelant prior art known to the Applicants at the time of filing the application.

639,035, Dec. 12, 1989, G. Hart; 1,616,531, Feb. 8, 1927, C. R. King; 1,928,314, Sept. 26, 1933, L. E. Koss; 2,479,078, Aug. 16, 1949, L. H. Milligan et al.; 3,067,551, Dec. 11, 1962, J. W. Maginnis; 3,867,795, Feb. 25, 1975, W. C. Howard; 4,292,768, Oct. 6, 1981, R. Panetti.

There is a type of grinding operation in which a side face of a grinding wheel is applied to the work being ground rather than the peripheral face. Such a wheel may be attached to the grinding machine in a variety of ways.

One such wheel is the so-called plate mounted wheel such as that described by Milligan et al in U.S. Pat. No. 2,479,078. This wheel is made up of a back plate, shown as B in the drawing, which is permanently attached to a grinding wheel A with a cement or adhesive. The wheel is attached to the shaft of a grinding machine through the hole in the back plate B by a suitable attaching means. Another wheel of this type is that taught by R. Panetti in U.S. Pat. No. 4,292,768. In this case, referring to the drawing, there is a grinding wheel (6) which is permanently and integrally attached to a metal plate (7 and 8), and a clamping flange (9) for clamping the plate of grinding wheel against a support flange. Upon mounting, the upper portion (7) of the mounting plate and the clamping flange (9) are centered around a collar (12) which protrudes from the support flange. The upper part (7) of the mounting plate is held in position, before clamping, by engagement of edges of two radial notches (14) below the retaining studs (16) of the two spindles (15) of the support flange (1). Two locking spindles (19) which are rigidly secured to the clamping flange (9) angularly immobilize the assembly by engagement in two corresponding holes (17) of the support flange. These types of wheels and their method of mounting require that the wheel include a permanently affixed mounting means i.e. the mounting plate is fabricated as part of the wheel.

A further wheel of this type, i.e. one where the grinding surface is a side face of the wheel rather than its peripheral surface, is the subject of U.S. Pat. No. 639,035 to G. Hart. The wheel, which happens to be a segmental wheel, does not include an integral mounting plate such as that taught by Milligan et al or Panetti, as a permanent part of the wheel. Instead the wheel is held and driven by a chuck which is made up of, again referring to the drawing, a circular base (1) with a centrally located hole (2) which is the means through which the chuck is attached to the shaft of a motor. The base (1) has an annular flange (3) extending around its outer edge and a second flange (4) concentric with the outer flange (3) but located within the latter thus forming a channel (5) between them. The grinding wheel (6) is located in the thusly formed channel (5). Clamping plates (7) are located between the inner wall of the grinding wheel and the outer wall of the inner flange (4). Screws (8) pass through holes in the inner flange (4) making contact with the clamping plates (9) forcing them against the inner surface of the wheel which causes the outer surface of the abrasive wheel to be forced against the inner surface of the outer flange (3). Spacer blocks (10) are inserted in the annular space or channel (5) to prevent any rearward movement by the abrasive wheel segments and to reduce the amount of wheel that would be unuseable if the entire volume of the annular channel (5) had to be filled with grinding wheel in order to take advantage of the support provided by the bottom or back surface of the channel (5).

A second example of a chuck arrangement for holding and driving a grinding wheel is that of Koss U.S. Pat. No. 1,928,314 which is a somewhat more complex chucking arrangement than that of the Hart patent. Thus chuck's relevance to the present invention resides in the fact that the chucking device causes or results in a forced contact between the abrasive wheel (again a segmental wheel), the flange (12) of the metal base plate (10) and the wedge member (25). Frequent changing i.e. replacement of the wheel in such a chuck, or a chuck such as that of Hart, will cause substantial wear on those surfaces of the chuck with which the abrasive wheel makes contact not to mention the not infrequent occurance where the chuck is initially not adjusted tightly enough against the wheel so that very damaging slippage between chuck and wheel occurs when the machine is initially applied to the work.

There are also grinding wheel chucks which utilize clamps which forceably grasp the outer periphery or peripheral surface of a cylinder type wheel which is solid as opposed to segmental. The present invention is concerned with the wear on chucking devices caused by both segmental and nonsegmental abrasive wheels and eliminates or greatly reduces such chuck wear.

The present invention is a composite wheel which is monolithic but made up of sections with differing compositions. Composite wheels per se generally, are not new. U.S. Pat. No. 1,616,531 to C. R. King describes a composite wheel consisting of three distinct layers or sections, a hard central abrasive section (10) sandwiched by two addition abrasive sections (11 and 12) which are softer by virtue of the fact that they are bonded with a softer, weaker bond than the bond used in the central section; this type of wheel is a cutting-off wheel and is used in such a manner that the peripheral edge makes contact with and cuts the material being processed. The Maginnis reference U.S. Pat. No. 3,067,551 is another multizoned or multisectional wheel which also grinds on its peripheral face and not a side face. This purpose of the Maginnis wheel is to accomplish with a single wheel, what normally takes two wheels to do i.e. remove a desired amount of metal at an economically rapid rate while imparting a high quality finish to the work piece. This objective is reached by constructing a wheel with a sandwich configuration as shown, in its simpler form, in FIG. 1 of the drawing where the peripheral grinding surface S presents to the work piece, a section C containing coarse abrasive grain for rapid metal removal flanked by two sections F containing fine abrasive. Both types of sections do contain abrasive and abrasive of the same type such as silicon carbide. The wheel is used by causing it to rotate at high speed, bringing the grinding surface S into contact with the work piece at one end and causing wheel to traverse the work piece in a given direction. In the direction of travel, the work piece first is subjected to one of the fine abrasive containing sections F which results in very little metal removal. However, following that leading F section is the coarse abrasive containing C section which does remove a substantial amount of metal. Lastly, the work piece is subject to the other fine abrasive section F which then polishes or removes the rough marks left by the coarse section C. The direction of the wheel is then reversed repeating the process. The Maginnis wheel does not grind on a side face and the entire thickness of the wheel contains highly abrasive particles. The invention wheel differs in that it is used on a side face and contains relatively nonabrasive material in its nongrinding portion.

Lastly, there is U.S. Pat. No. 3,867,795, the Howard patent. The wheel disclosed is used, to some degree, on a side face thereof; it is actually used partially on a side face and partially on the peripheral face. The wheel is also made up of two sections, a primary grinding section or layer (20) and a secondary abrading section (26). Both sections do contact the work piece and do grind i.e. remove metal. The invention wheel by contrast, is not used in such a manner that both sections of the wheel contact the work piece and the back (less abrasive) section is where the holding and driving means makes exclusive contact. The Howard patent is relevant for its teaching of a layered wheel wherein the back layer may contain a less abrasive material, e.g. garnet, silica, emery, flint and quartz. These materials are useable in the wheel of the present invention.

DISCLOSURE OF THE INVENTION

The invention is an improved grinding wheel of the cylinder type, or that type of wheel that grinds on a side surface rather than on its peripheral surface, as is the case with most grinding wheels, and is held by a chuck or holding means. The wheel of the invention may be a segmental wheel such as those shown in the Hart and Koss references in which case chucks or holding means such as those shown in those patents must be used. However, the wheel may be a unitary i.e. a one piece wheel 10 such as that shown in the drawing; in that case the chuck will have to be segmented, i.e. a moveable jaw type chuck such as that schematically shown in FIG. 2, which grips the wheel on the peripheral face. FIG. 2 shows the invention wheel 10 with sections 12 and 14, with the jaws or clamping elements 16 of the chuck interfacing with the peripheral face of the upper abrasive grain free section 12.

Frequent clamping and unclamping a wheel which contains abrasive grain throughout its thickness causes severe wear on the steel jaws 16 of the chuck. By making the upper section of the wheel with less abrasive particles, that wear is eliminated or greatly reduced depending on the hardness of the particular material used. The thickness of the less abrasive upper section 12 of the wheel 10 can vary but it should be at least thick enough to accomodate the entire surface of jaws 16 that will be in contact with the wheel. The wheel 10 is made up of two zones or sections as shown in FIG. 1, a lower section 14 made up of abrasive grains having a Mohs hardness of at least 8 and a vitrified or organic polymer bond for the abrasive grains, and an upper section 12 in FIG. 1 which is composed of particles which are substantially less abrasive than the abrasive grains in the lower section 14, the less abrasive particles having a Mohs hardness of from 2 to less than 8 and being bonded with the same vitrified or organic polymer bond as are the abrasive particles in the lower section 14. The wheels are made in the conventional manner.

Any abrasive grain can be employed in the lower or grinding section so long as it has a Mohs hardness of at least 8, as pointed out above. However, the preferred abrasive is one selected from the group consisting of silicon carbide, fused alumina, confused alumina-zirconia, sintered alumina, cosintered alumina-zirconia, cubic boron nitride, diamond, and mixtures thereof. The abrasive grain can have a particle size of from 100 to 4000 microns. The bond for the abrasive grain may be any vitrified bond or any organic polymer based bond such as phenol-formaldehyde, polyester, epoxy, urethane, polybenzimidazole and the like. The bonds may also include any of the fillers and grinding aids known in the art that are amenable with the two types of bonds.

The upper section can be made up of any of a large number of particulate materials so long as it is less abrasive than the abrasive grain in the lower section of the grinding wheel, including glass fibers, organic fibers, crushed nut shells, hard wood chips, and mixtures of these materials where the bond therefor is an organic polymer bond. Also suitable are metal powders such as steel, iron, copper, aluminum and mixtures thereof. When the bond is of the vitrified type the preferred particulate material for the upper section is kyanite, wollastonite, mullite, garnet, quartz, fluorite, mica, nephaline syenite, barium sulfate, calcium carbonate, and of course any mixture or combination of these materials. Obviously, these particulate materials may be utilized with organic polymer based bonds as well. The average particle of this material in the upper section 12 may be from 44 to 4000 microns.

Finally, the abrasive grain containing section 14 and the less abrasive particle containing section 12 may have the following volume percent composition in order to produce a grinding wheel with adequate physical strength and grinding properties:

abrasive grain or less abrasive particles, 20–70%;
resinoid or vitrenous bond, 2–60%;
fine filler and/or grinding aid, 0–50%;
porosity, 0–60%.

DESCRIPTION OF THE PREFERRED EMBODIMENT

Figure 1:
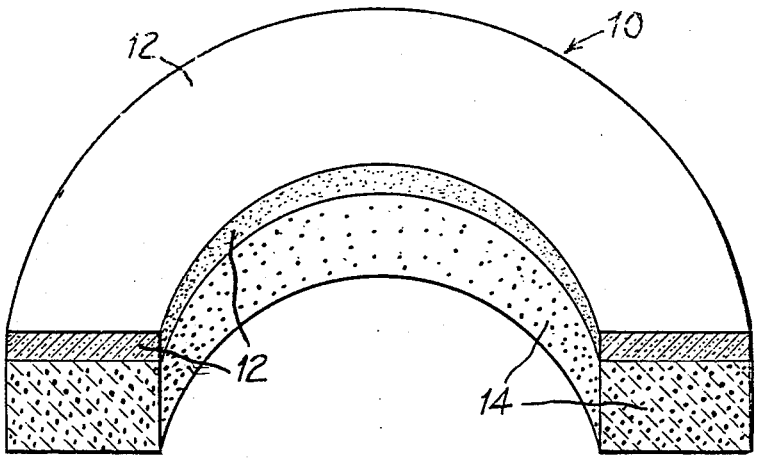
FIG. 1 is a perspective sectional view through the wheel of the present invention.
Figure 2:
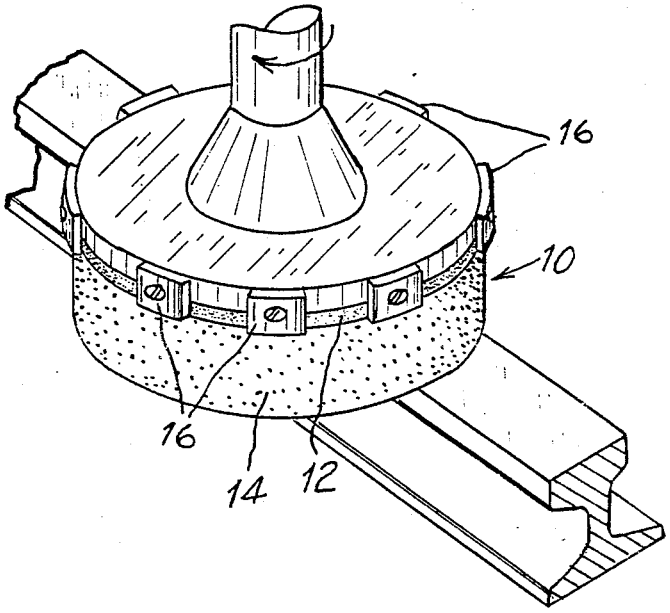
FIG. 2 is a perspective view of the wheel of the present invention showing, schematically, the clamping jaws of a chuck in contact with and holding said wheel.

A railroad track grinding wheel, according to the invention, having an outside diameter of 25.9 cm (10.19 inches), an inside diameter of 14.9 (5.87 inches) and a thickness of 7.62 cm (3 inches) was made in the following manner:

A 13.6 kg (30 lb) quantity of a conventional grinding wheel mix was prepared in the known manner. The mix, on a weight percent basis, was made up of 58.6% cofused alumina-zirconia abrasive having an average grain size of 1190 microns, 18% fused aluminum oxide abrasive having an average particle size of 1190 microns, 9.7% of commercial powdered 2-stage phenolformaldehyde resin, 11.9% of barium sulfate filler with an average particle size of about 5 microns, and 1.8% quick lime with an average particle size of about 4 microns; the mix also contained 60 ml of furfuraldehyde per pound of resin which was added to the abrasive grain just prior to addition of the above described bond materials i.e. resin, barium sulfate and lime which were prebatched with 131 ml of Carbosota before being added to the furfuraldehyde wetted abrasive grain. 5.98 kg (13.19 lb) of this mix was placed in a standard steel mold set-up which had an I.D. of 25.9 cm (10.19 inches) fitted with an arbor with an O.D. of 14.9 cm (5.87 inches).

9.07 kg (20 lb) of a second mix was made in the same manner as described above except that this mix had a weight percent composition of 74.7% kyanite with an average particle size of 250 microns, 13% powdered 2-stage phenolformaldehyde resin. 10.5% of wollastonite filler with an average particle size of 14 by 80 microns, and 1.8% quick lime; this mix also utilized furfuraldehyde in the amount of 63 cc per pound of resin which had previously been blended with 12 cc of chlorinated paraffin per pound of resin, and 30 cc of tridecyl alcohol per pound of dry resin. 1.66 kg (3.66 lb) of this mix was placed on top of the first mix in the mold, the top plate put in place and the contents of the mold pressed to a thickness of 7.68 cm (3.03 inches) at atmospheric temperature. The green wheel was removed from the mold and heat treated for 20 hours with a maximum soak temperature of 185° C. The resulting approximately 7.68 cm (3.03 inches) thick wheel had an upper section measuring approximately 1.9 cm (0.75 inch) thick containing the less abrasive kyanite in place of the usual highly abrasive cofused alumina-zirconia abrasive.

What is claimed is:

1. A grinding wheel for use with a clamping means firmly holding said grinding wheel on a section of a peripheral face, so that the clamping means and the grinding wheel may be driven, comprising a first and a second section, said second section constituting a grinding section composed of abrasive grain and a bond therefor, said first section being the section of said wheel which interfaces on its peripheral face with said clamping means, the first section being composed of particles that are less abrasive than said abrasive grain, and a bond therefor, wherein the first and second sections thereof have the following volume percent composition:

abrasive or less abrasive particles, 20–70%;
resinoid or vitreous bond, 2–60%;
fine filler and grinding aid, 0–50%;
porosity, 0–60%;

said abrasive grain of the second section having an average particle size of 100 to 4000 microns and said particles of the first section having an average particle size of 44 to 4000 microns.

2. The wheel of claim 1, wherein said particles in said first section are selected from the group consisting of glass fibers, organic fibers, crushed nut shells, wood chips, and mixtures thereof, and said bond is an organic polymer based bond.

3. The wheel of claim 1, wherein said particles are selected from the group consisting of steel, iron, copper, aluminum, kyanite, and alusite, wallastonite, mullite, garnet, quartz, fluoride, mica, nephaline, syenite, barium sulfate, calcium carbonate, cryolite and mixtures thereof and said bond is selected from the group consisting of organic polymer based and vitrified bonds.

4. The wheel of claim 1, wherein said abrasive grain is selected from the group consisting of silicon carbide, fused alumina, co-fused alumina-zirconia, sintered alumina, co-sintered alumina-zirconia, cubic boron nitride, diamond, and mixtures thereof.

5. Process for holding and driving a grinding wheel comprising the steps of firmly holding said grinding wheel on a section of a peripheral face with means for clamping the wheel and driving the clamping means and grinding wheel, wherein said grinding wheel has an upper and a lower section composed of abrasive grain and a bond therefor, said upper section being the section of said wheel which interfaces on a peripheral face with said clamping means, the upper section being composed of particles that are less abrasive than said abrasive grain, and a bond therefor, wherein the upper and lower sections thereof have the following volume percent composition:

abrasive or less abrasive particles, 20–70%;
resinoid or vitreous bond, 2–60%;
fine filler and grinding aid, 0–50%;
porosity, 0–60%;

said abrasive grain having an average particle size of 100 to 4000 microns and said less abrasive particles having an average particle size of 44 to 4000 microns.

6. The process of claim 5, wherein said particles in said upper section are selected from the group consisting of glass fibers, organic fibers, crushed nut shells, wood chips, and mixtures thereof, and said bond is an organic polymer based bond.

7. The process of claim 5, wherein said particles are selected from the group consisting of steel, iron, copper, aluminum, kyanite, alusite, wallastonite, mullite, garnet, quartz fluoride, mica, nephaline, syenite, barium sulfate, calcium carbonate, cryolite and mixtures thereof, and said bond is selected from the group consisting of organic polymer based and vitrified bonds.

8. The process of claim 5, wherein said abrasive grain is selected from the group consisting of silicon carbide, fused alumina, co-fused alumina-zirconia, sintered alumina, co-sintered alumina-zirconia, cubic boron nitride, diamond and mixtures thereof.

* * * * *